US009157244B1

(12) United States Patent
Kelly

(10) Patent No.: US 9,157,244 B1
(45) Date of Patent: Oct. 13, 2015

(54) CONSTRUCTION DEVICE FOR RELEASING MOISTURE FROM A BUILDING

(71) Applicant: Robert Kelly, Deerfield, IL (US)

(72) Inventor: Robert Kelly, Deerfield, IL (US)

(73) Assignee: Wickright, Inc., Deerfield, IL (US)

( * ) Notice: Subject to any disclaimer, the term of this patent is extended or adjusted under 35 U.S.C. 154(b) by 0 days.

(21) Appl. No.: 14/738,841

(22) Filed: Jun. 13, 2015

Related U.S. Application Data

(62) Division of application No. 14/487,590, filed on Sep. 16, 2014.

(60) Provisional application No. 61/878,091, filed on Sep. 16, 2013.

(51) Int. Cl.
*E04F 17/00* (2006.01)
*E04F 13/00* (2006.01)
*E04F 17/04* (2006.01)

(52) U.S. Cl.
CPC ..... *E04F 17/04* (2013.01); *E04F 13/007* (2013.01)

(58) Field of Classification Search
CPC ..... E04F 17/04; E04F 13/007
USPC ..... 52/302.1, 300, 60, 96, 97, 198, 302.6, 52/408
See application file for complete search history.

(56) References Cited

U.S. PATENT DOCUMENTS

| | | | | |
|---|---|---|---|---|
| 3,862,531 | A * | 1/1975 | Attaway et al. | 52/300 |
| 4,083,158 | A * | 4/1978 | Wolma | 52/300 |
| 5,704,176 | A * | 1/1998 | Greenberg | 52/300 |
| 7,168,209 | B2 * | 1/2007 | Heidler, Jr. | 52/60 |
| 7,179,165 | B2 * | 2/2007 | Cook | 454/360 |
| 8,001,739 | B1 * | 8/2011 | Inzeo et al. | 52/300 |
| 8,561,367 | B2 * | 10/2013 | Kelly | 52/300 |
| 2003/0051428 | A1 * | 3/2003 | Kay et al. | 52/566 |
| 2013/0074428 | A1 * | 3/2013 | Allen et al. | 52/173.3 |
| 2013/0192154 | A1 * | 8/2013 | Kelly | 52/300 |

* cited by examiner

*Primary Examiner* — Mark Wendell
(74) *Attorney, Agent, or Firm* — Justin Lampel

(57) ABSTRACT

A plurality of devices used alone or in combination for releasing moisture from a building are provided. The devices are especially suitable for use in new or existing masonry and frame buildings with low-slope roofs, on parapet walls and mansard roofs, and on masonry walls and foundation walls. The devices give buildings adequate wall and roof system ventilation and moisture vapor release portals so as to better prevent mold and other water related damage. The devices may be used individually or in combination wherein the devices are placed on or against a parapet wall, masonry wall or foundation wall of a building. Further, the devices may be used in connection with a joist or truss system of a building to prevent moisture damage to the joists or truss system and to prevent compromises and other structural integrity problems to a building which often occur with moisture.

7 Claims, 7 Drawing Sheets

FIG. 1
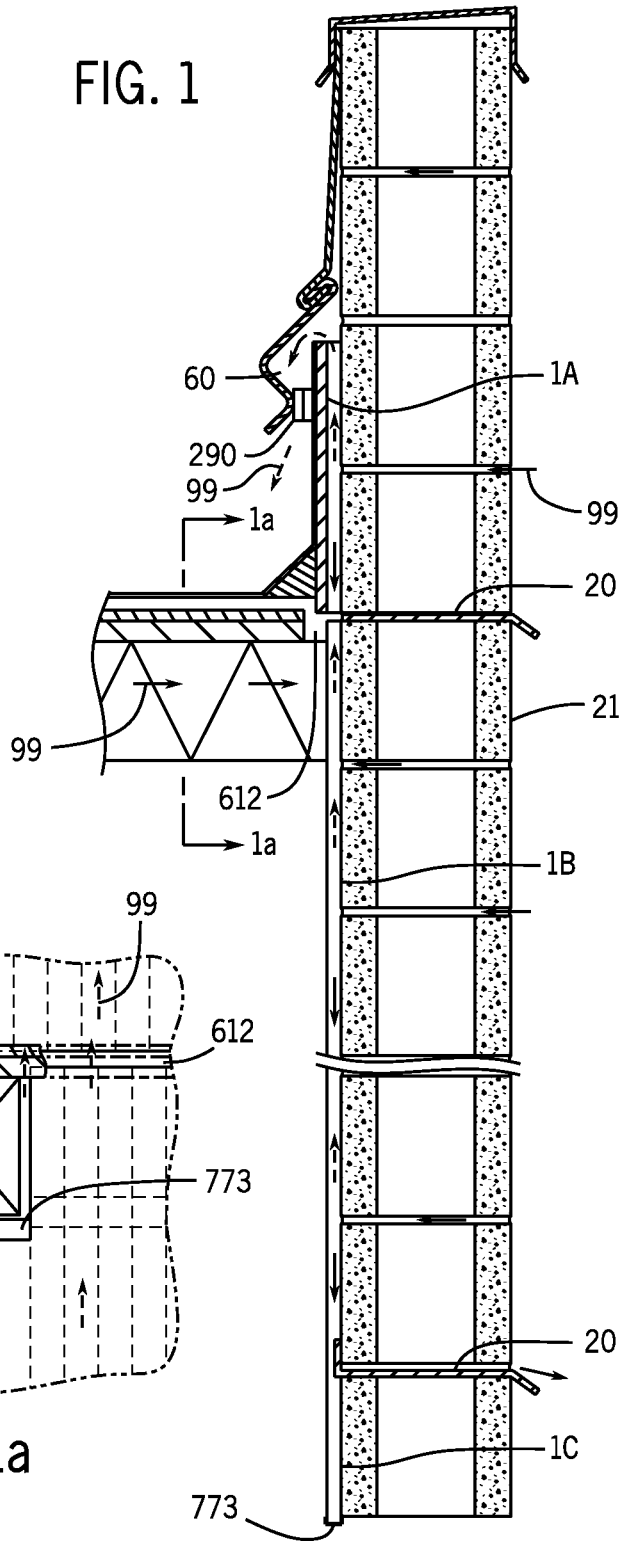
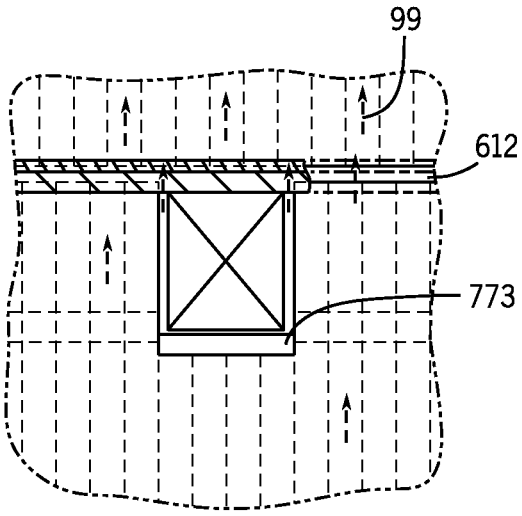
FIG. 1a

CONSTRUCTION DEVICE FOR RELEASING MOISTURE FROM A BUILDING

CROSS REFERENCE TO RELATED APPLICATIONS

The following application is a divisional application based on Ser. No. 14/487,590 the parent of which is further based on and claims the priority benefit of U.S. provisional application Ser. No. 61/878,091 filed Sep. 16, 2013; the entire contents of which are incorporated by reference.

BACKGROUND OF THE INVENTION

A plurality of devices used alone or in combination for releasing moisture from a building are provided. The devices are especially suitable for use in new or existing masonry and frame buildings with low-slope roofs, on parapet walls and mansard roofs, and on masonry walls and foundation walls. The devices give buildings adequate wall and roof system ventilation and moisture vapor release portals so as to better prevent mold and other water related damage. The devices may be used individually or in combination wherein the devices are placed on or against a parapet wall, masonry wall or foundation wall of a building. Further, the devices may be used in connection with a joist or truss system of a building to prevent moisture damage to the joists or truss system and to prevent compromises and other structural integrity problems to a building which often occur with moisture. The devices are adjustable in size so as to allow them to be utilized in connection with virtually any size wall, which may eliminate waste and promote ease of installation.

Attempts have been made to provide construction devices that release moisture vapor from buildings. For example, U.S. Pat. No. 8,468,750 to Clearfiled discloses a seal for a flashing joint on an open frame structure using a first barrier sheet having first and second adhesive strips on opposing primary surfaces proximate to opposing edges and running the length of the first barrier sheet by applying the first barrier sheet over the flashing joint with one edge below the flashing joint and adhering an adhesive strip to a building element below the flashing joint with the first adhesive strip and applying a second barrier sheet overlapping the first barrier sheet and adhere the first and second barrier sheets together using the second adhesive strip. The process can include applying flashing over the first barrier sheet and flashing joint and then overlaying the flashing with the second barrier sheet and sealing the second barrier sheet to both the first barrier sheet and the flashing.

Further, U.S. Pat. No. 6,886,301 to Schilger discloses a building construction device for exterior building walls. The construction comprises an interior frame formed of a plurality of laterally spaced studs or beams, a layer of rigid insulation adjacent to the exterior side of this steel frame, exterior building cladding adjacent the exterior side of the rigid insulation and a plurality of low conductivity connectors, e.g. insulating plastic connectors or thin metal strips having an insulating plastic foam coating, extending through the layer of rigid insulation and connecting together the exterior cladding and the interior steel studs or beams. Vertical channels are formed adjacent both the inside and outside faces of the insulation layer to remove moisture. This provides the required structural strength with a minimum of thermal conductivity from the warm side to the cold side of the building envelope, while providing exterior drain channels and interior moisture removing channels.

Further, U.S. Pat. No. 8,425,288 to Snipes, Jr. discloses a foundation vent assembly for a masonry foundation wall having a metal frame mounted in an opening registering with a crawl space area. The frame orients and supports a series of spaced vertical grill blocks matching the foundation masonry and integrated with the surrounding mortar joints, thereby providing a continuous appealing exterior appearance. The spaces between the grill blocks register with ventilation slots in the rear of the frame. The ventilations slots are covered by a screen mesh to prevent pest infiltration, and optionally covered with a pivoting damper for selective opening and closing, having a rear wall covering the opening with spaced screen vents. The grill blocks are aligned by tabs on upper and lower flange walls between the vents and provide for extension of the foundation mortar joints thereby providing a consistent overall facade.

However, these patents fail to provide a device for releasing moisture from a building as described in the present application. A need, therefore, exists for an improved device for releasing moisture from a building that has the features of the present invention.

SUMMARY OF THE INVENTION

A plurality of devices used alone or in combination for releasing moisture from a building are provided. The devices are especially suitable for use in new or existing masonry and frame buildings with low-slope roofs, on parapet walls and mansard roofs, and on masonry walls and foundation walls. The devices give buildings adequate wall and roof system ventilation and moisture vapor release portals so as to better prevent mold and other water related damage. The devices may be used individually or in combination wherein the devices are placed on or against a parapet wall, masonry wall or foundation wall of a building. Further, the devices may be used in connection with a joist or truss system of a building to prevent moisture damage to the joists or truss system and to prevent compromises and other structural integrity problems to a building which often occur with moisture. The devices are adjustable in size so as to allow them to be utilized in connection with virtually any size wall, which may eliminate waste and promote ease of installation.

An advantage of the present device is that the present device allows moisture to easily escape from the walls and/or roof of a building.

Yet another advantage of the present device is that the present device prevents condensation from forming within the building or from reentering the walls of the building.

Still another advantage of the present device is that the present device includes a medium density overlay plywood that provides a uniform surface to which roofing materials easily and efficiently adhere to the parapet walls of a building (which is an extension of the exterior wall of a building located above the roof level of the building).

And an advantage of the present device is that the present device reduces the intake of driving rain.

Still another advantage of the present device is that specific units of the present device may be used in new construction or may be retrofitted into existing construction. An advantage of the present device is that that the present device drains moisture away from joists or truss system of a building.

Still another advantage of the present device is that the present device may be used under the capstone of a building and may serve as a flashing under the capstone to drain moisture away from the wall core.

For a more complete understanding of the above listed features and advantages of the moisture releasing construction device reference should be made to the following detailed description of the preferred embodiments and to the accompanying drawings. Further, additional features and advantages of the present invention are described in, and will be apparent from, the detailed description of the preferred embodiments and from the drawings.

BRIEF DESCRIPTION OF THE DRAWINGS

FIG. 1 illustrates a side view of embodiments of three first unit moisture releasing devices used at: the junction of the roof system and the parapet wall of a building, at a wall of a building and at a foundation of a building.

FIG. 1*a* illustrates a side view an embodiment of the moisture releasing device used in connection with a joist.

DETAILED DESCRIPTION OF THE PREFERRED EMBODIMENTS

A plurality of devices used alone or in combination for releasing moisture from a building are provided. The devices are especially suitable for use in new or existing masonry and frame buildings with low-slope roofs, on parapet walls and mansard roofs, and on masonry walls and foundation walls. The devices give buildings adequate wall and roof system ventilation and moisture vapor release portals so as to better prevent mold and other water related damage. The devices may be used individually or in combination wherein the devices are placed on or against a parapet wall, masonry wall or foundation wall of a building. Further, the devices may be used in connection with a joist or truss system of a building to prevent moisture damage to the joists or truss system and to prevent compromises and other structural integrity problems to a building which often occur with moisture. The devices are adjustable in size so as to allow them to be utilized in connection with virtually any size wall, which may eliminate waste and promote ease of installation.

Figure 5:
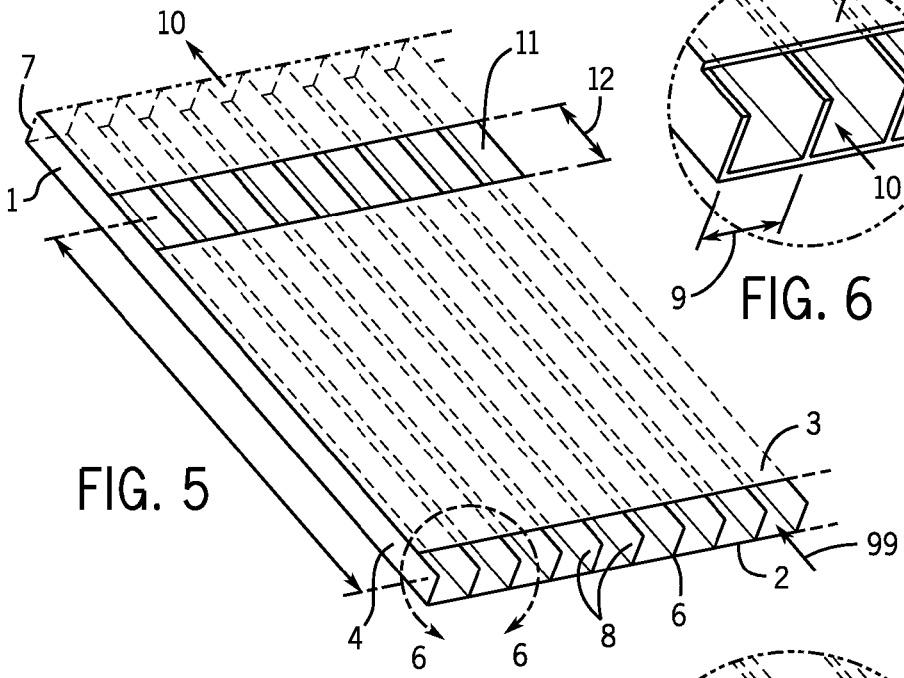
FIG. 5 illustrates a perspective bottom view of an embodiment of the first unit moisture releasing device of FIG. 3 wherein a gap on the bottom layer of the first unit moisture releasing device aligns with a mortar joint between bricks or the mortar joint between concrete masonry units of a building and allows the moisture from the bricks or concrete masonry units of the building to escape through the gap and then through the interior of the first unit moisture releasing device.

Referring first to FIGS. 1 and 5, in an embodiment, a first unit moisture releasing device 1 is provided. The present devices may be used in new construction or may be retrofitted into existing construction. The first unit moisture releasing device 1 is ideally used in connection with a roof (FIG. 1A), a wall (FIG. 1B) and a foundation (1C). For the roof unit (1A) one side of the device 1 may be positioned to the exterior and may be asphalt primed to facilitate the easy application of roofing materials such as, for example, tar, bitumen, etc.

Although the first unit moisture releasing device 1 may be constructed in various embodiments (as discussed below) the various embodiments of the first unit moisture releasing device 1 generally operate in the same way. As illustrated in FIG. 1, the first unit moisture release device 1 allows water vapor to rise up, as indicated by the dotted arrows, and exit out of a vent 60 while moisture may drain downward as indicated by the solid arrows of FIG. 1.

The first unit moisture releasing device 1 allows heat and moisture vapor to escape from a building. The device 1 (shown inverted in FIG. 5) may have a top 2, a bottom 3, a front 4, a back (not shown), a first side 6 and a second side 7. In an embodiment, the first unit may be generally made of a corrugated plastic material 290. The exact sizes of the device 1 may vary depending on the building for which the device 1 is used in, but 10 mm corrugated plastic 290 is preferable when maximized air flow is desired. In alternative embodiments of the device (IE—the second unit 200 and third unit 400 discussed below), 4 mm corrugated plastic 290 is ideal for restricting the passage of insects into the building as the openings of the corrugated plastic is smaller. Further, utilizing multiple layers of the 4 mm corrugated plastic 290 increases overall air flow of the device 1, decreases possible damage from water vapor or moisture 99 while still restricting insect passage. In an embodiment, the corrugated plastic layer 290 may also be placed at a vent 60 (FIG. 1) in addition to along the wall (FIGS. 1A, 1B and 1C) so as to prevent insects from entering the building while still allowing the escape of water vapor and moisture 99.

Figure 6:
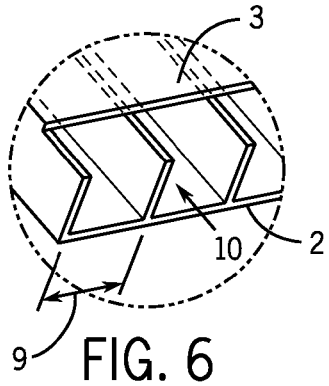
FIG. 6 illustrates a close up view of the side of the first unit moisture releasing device of FIG. 5 and FIG. 3.

The top 2 of the first unit may be separated from the bottom 3 of the first unit by a plurality of generally parallel support dividers 8; wherein the support dividers 8 are generally parallel to each other and generally perpendicular to the top 2 and to the bottom 3 of the first unit moisture releasing device 1. The generally parallel support dividers 8 may provide structural support for the top 2 and the bottom 3 of the device 1. A width 9 (FIG. 6) may be present between any two of the generally parallel support dividers 8. A plurality of generally elongated square passageways 10 therein exists between the first side 6 and second side 7 of the first unit moisture releasing device 1 such that moisture and water vapor 99 may pass from the first side 6 of the first unit moisture releasing device 1 to the second side 7 (or vice versa) through the generally elongated square passageways 10.

The bottom 3 of the first unit moisture releasing device 1 may have a gap 11 in having a width 12. More specifically, the gap 11 may be a portion of the bottom 3 of the first unit moisture releasing device 1 which is missing; therein exposing a portion of the generally parallel support dividers 8 and generally elongated square passageways 10 below the bottom 3. Preferably, the width 12 of the gap 11 is slightly larger than a width 22 of a mortar joint 20 between bricks 21 (or concrete masonry unit) of a building (see FIGS. 3 and 4). More specifically, the width 12 of the gap 11 is preferably two to three times the width 22 of the mortar joint 20.

Figure 2:
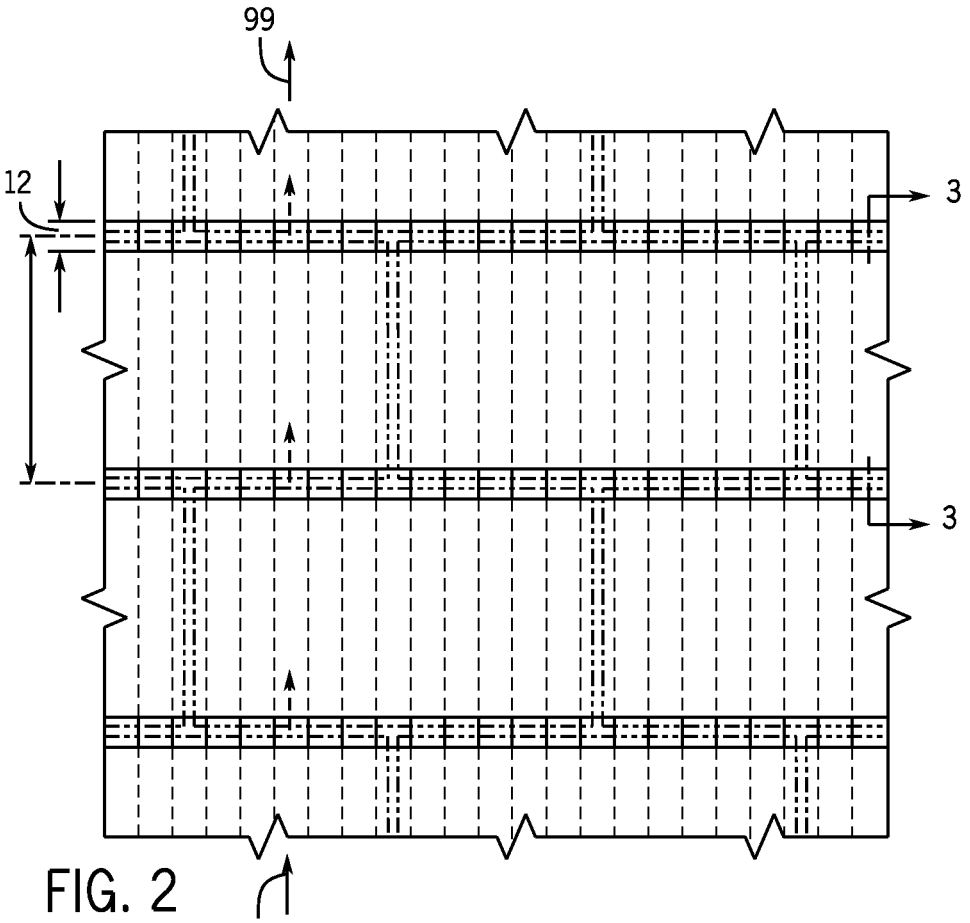
FIG. 2 illustrates a top view of an embodiment of the first unit moisture releasing device wherein gaps in the device are strategically aligned with typical mortar joint configurations of a building—these openings are shown in phantom behind an embodiment of the first unit moisture releasing device.
Figure 3:
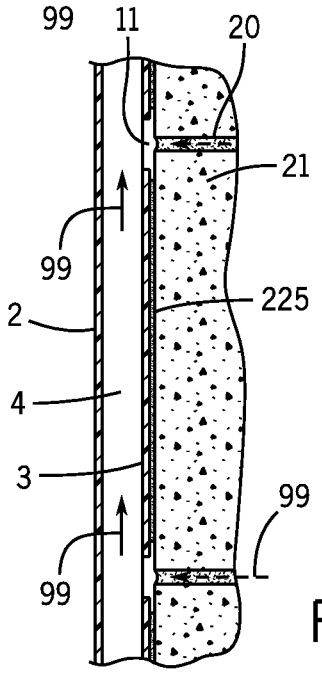
FIG. 3 illustrates a side view of an embodiment of the first unit moisture releasing device secured to a masonry wall or foundation wall wherein the top layer of the device is a 10 mm corrugated plastic layer.
Figure 4:
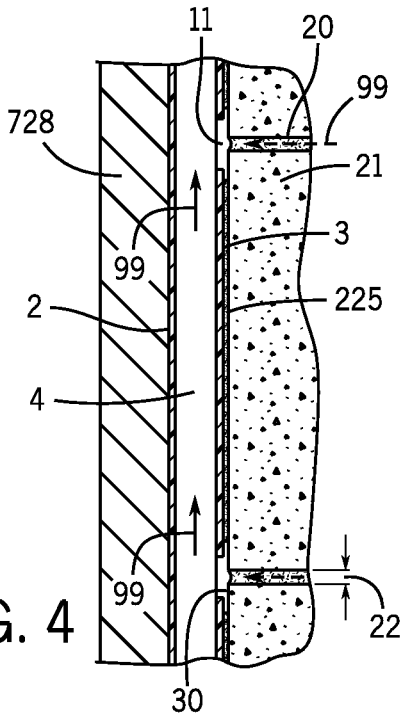
FIG. 4 illustrates a side view of an embodiment of the first unit (FIG. 1A) moisture releasing device secured to a wall and roof junction wherein the bottom layer of the device is a 10 mm corrugated plastic and the top layer of the device has a ½" medium density overlay layer.

The first unit moisture releasing device 1 may have a plurality of gaps 11 located along the bottom 3 at a distance from each other approximately equal to the distance between the mortar joints 20 of the bricks 21 such that all of the gaps 11 of the first unit moisture releasing device 1 align with the all of the mortar joints 20 of the bricks 21. FIGS. 3 and 4 illustrate two of the gaps 11 and two mortar joints 20 aligned with each other; however the device 1 may be used along the entire height of the wall therein allowing all of the gaps 11 of the first unit to align with all of the mortar joints 20.

Under normal circumstances, water vapor and moisture 99 can penetrate into a building through the mortar joints 20 of the building and may cause damage to the building's framing timbers, insulation and drywall. By placing the first unit moisture releasing device 1 directly against the interior side 30 of the bricks 21 or concrete masonry units, any water vapor and moisture 99 which flows into the building through the mortar joints 20 now passes through the gap 11 of the first unit moisture releasing device 1 and then into the generally elongated square passageways 10 and out to a vent 60 (shown in FIG. 1) therein preventing damage to the building.

Although the device 1 may be used without this alteration, in an embodiment, a portion of the first unit may be cut-away and removed to accommodate a portion of a joist as is illustrated in FIG. 1A. In this embodiment, a cap 773 may be placed over the cut-away portion of the first unit therein preventing water vapor or moisture 99 release from the interior of the first unit directly onto the joist.

Although the device 1 may be used without it, in an embodiment, a thin layer made of, for example, a vapor permeable membrane 225 may be placed between the bottom 3 of the first unit moisture releasing device 1 and the bricks 21 of the building. The vapor permeable membrane 225 may allow water vapor 99 to pass through while preventing liquid water from passing through and possibly entering the roof system.

Figure 7:
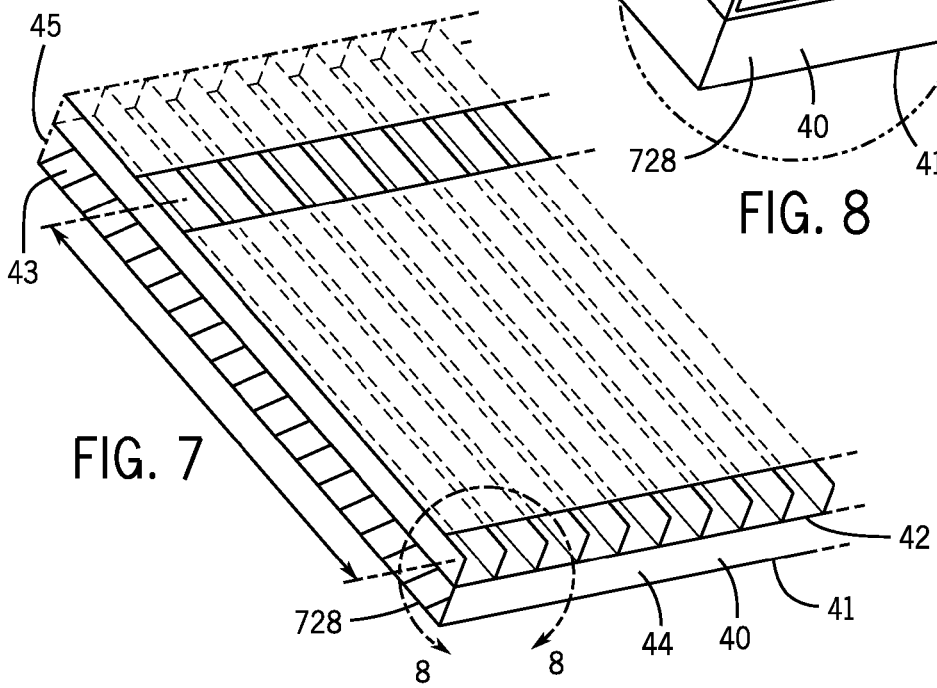
FIG. 7 illustrates a bottom view of an alternative embodiment of the first unit moisture releasing device of FIG. 4 wherein a gap on the bottom layer of the first unit moisture releasing device aligns with a mortar joint and roof system cavity and wherein the moisture releasing device has a second layer (made of plywood or medium density overlay) secured to the top of the first unit.
Figure 8:
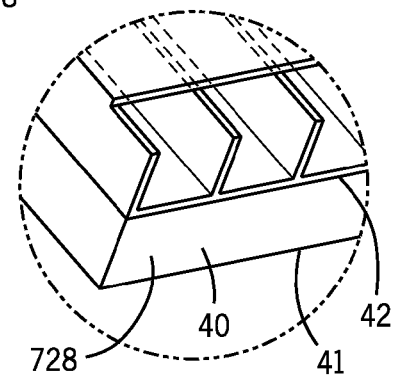
FIG. 8 illustrates a close up view of the side of the embodiment of the first unit of FIG. 7 and FIG. 4.

Referring now to FIGS. 7 and 8, in an alternative embodiment, the first unit moisture releasing device 1 may have a base support unit 40. The base support unit 40 may have a top 41, a bottom 42, a front 43, a back (not shown), a first side 44 and a second side 45 wherein the bottom 42 of the support unit 40 may be permanently secured to the top 2 of the first unit moisture releasing device 1 by, for example, an adhesive. The support unit 40 may allow the finished layer of a roof to be secured to the first unit moisture releasing device 1 which is secured to the parapet wall, as is shown in FIG. 1A. In an embodiment, the base support 43 may be a plywood or a medium density overlay 728 (FIG. 4) is secured to the front 43 of the device 1 so as to provide a uniform surface to which roofing materials may easily and efficiently be secured to so that the device 1 may be easily secured on the parapet walls of the building.

Figure 9:
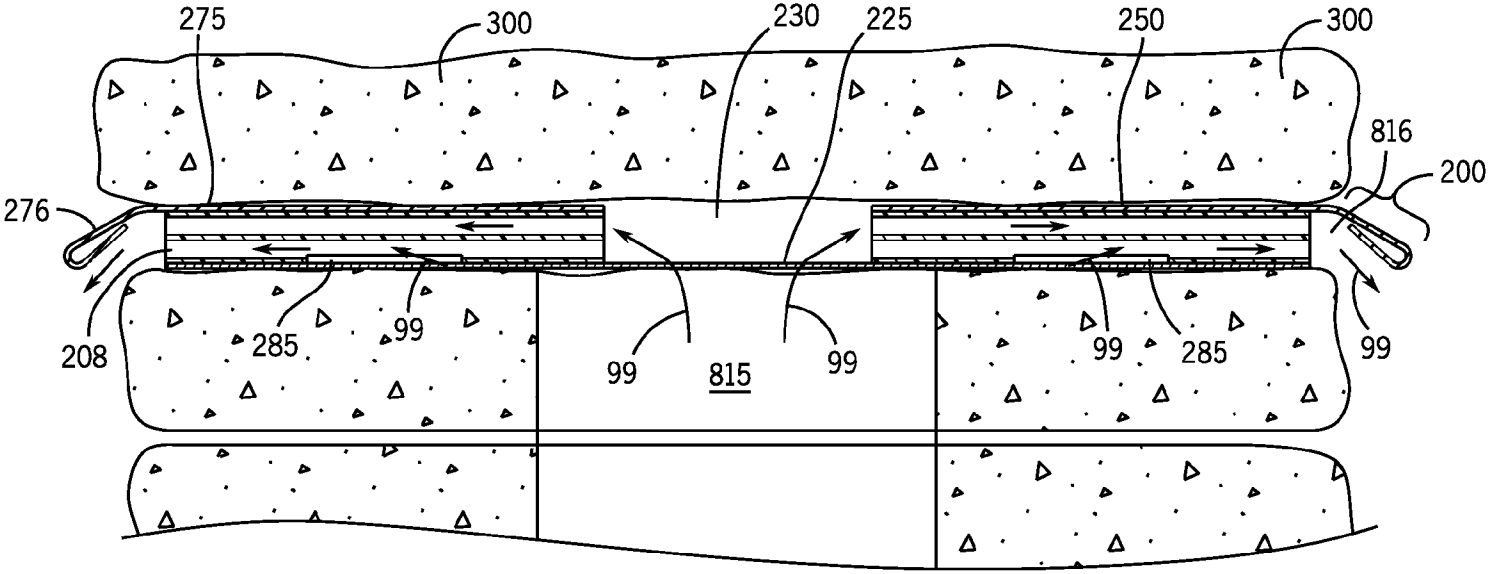
FIG. 9 illustrates a cross sectional view of a second unit moisture releasing device element inserted under a capstone.
Figure 10:
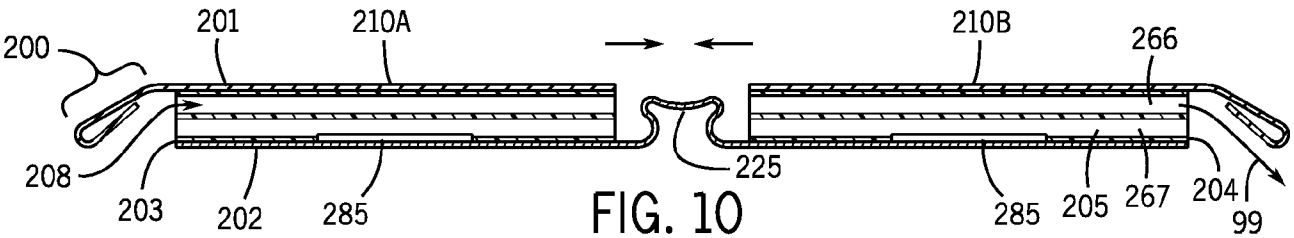
FIG. 10 illustrates a cross sectional view of the second unit (similar to FIG. 9) moisture releasing device of FIG. 9 without the device inserted under a capstone.

Referring now to FIGS. 9 and 10, in an embodiment, a second unit moisture releasing device 200 is provided. The second unit moisture releasing device 200 may have a top 201, a bottom 202, a front 203, a back 204, a first side 205, a second side (not shown) and a plurality of parallel passageways 208 which allow the water vapor and moisture 99 to pass through (similar to the passageways 10 of the first unit). Further, the second unit moisture releasing device 200 may be divided into two substantially similar or identical sections 210A and 210B. An adjustable thin layer (for example, the vapor permeable membrane) 225 may be flexible and may connect the two sections 210A and 210B together. As stated above, the thin layer 225 may be made from, for example, a vapor permeable membrane 225 which allows the water vapor and moisture 99 to pass through the thin layer 225 while still preventing the passage of water, condensation and wind-driven rain.

The thin layer 225 may allow the first section 210A and the second section 210B to be used at an angle with respect to each other (or in non-planar orientation) and may also allow the first section 210A and second section 210B to be used at various distances from each other (for example used in conjunction with an 8 inch wall or a 14 inch wall). More specifically, FIG. 9 illustrates the two sections 210A and 210B being used under a capstone 300 in a generally parallel orientation wherein a fourteen inch wall is used (and the thin layer 225 is therein stretched out) whereas FIG. 10 illustrates the thin layer 225 bunched up in the center so that the first section 210A and second section 210B may be brought in toward each other to use in connection with an eight inch wall (wall not shown in FIG. 10). Accordingly the edges of the first section 210A and the second section 210B may therein be positioned substantially flush with the exterior edge of the capstone 300 while a gap 230 between the first section 210A and second section 210B in the center of the capstone 300 varies in length.

Located beneath a capstone 300 may be an empty space 815 (FIG. 9) within the interior of the brick or concrete masonry unit. As stated above, a gap 230 may be located between the first second 210A and 210B. The gap 230 may allow water vapor and moisture 99 to flow through the empty space 815 of the interior of the brick or concrete masonry unit, through the thin layer membrane 225, then through the passageways 208 of the first section 210A and second section 210B and out through a vent 816.

Figure 11:
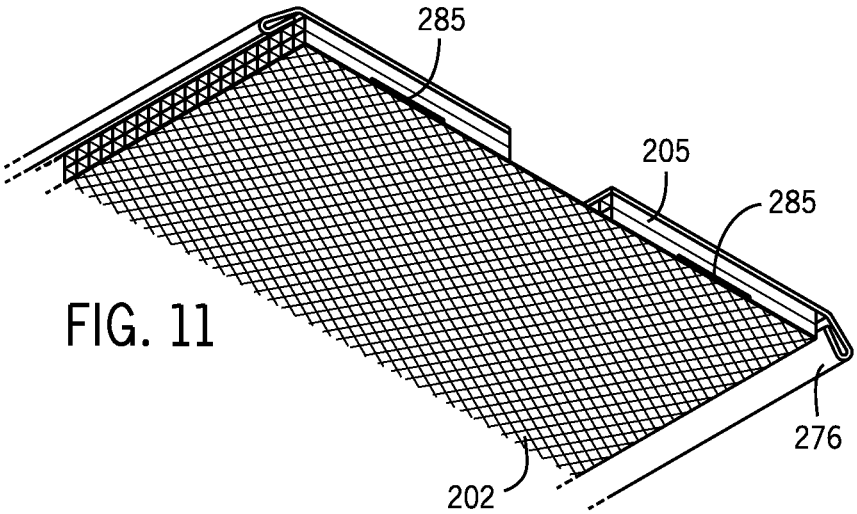
FIG. 11 illustrates a perspective view of the bottom of the second unit moisture releasing device which is inserted under a capstone.
Figure 12:
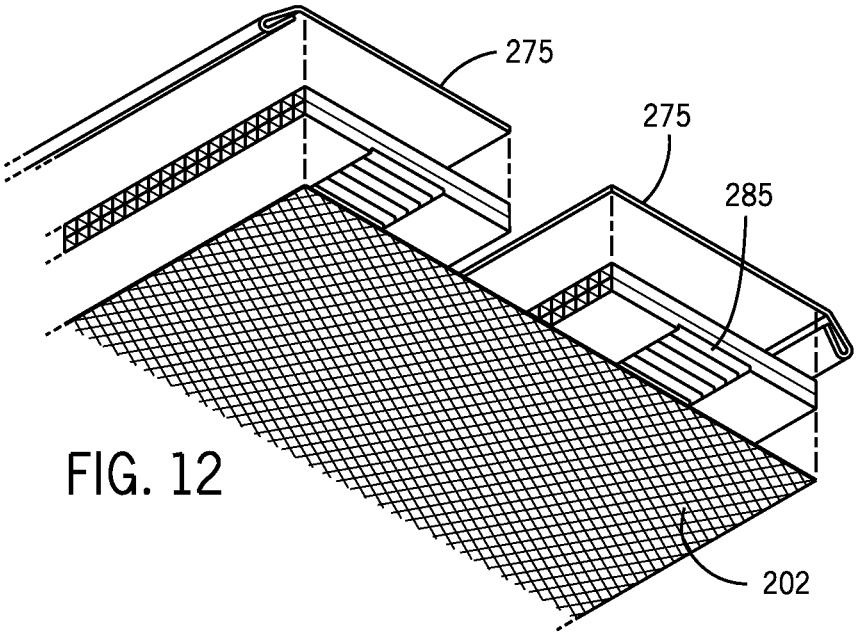
FIG. 12 illustrates an exploded view of the layers of FIG. 11 of the second unit moisture releasing device which is inserted under a capstone.
Figure 13:
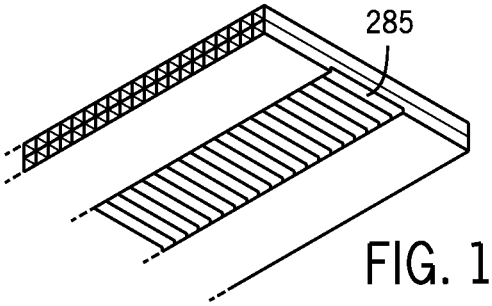
FIG. 13 illustrates a perspective view of a first section of the second or third unit moisture releasing devices.

In an alternative embodiment, the second unit moisture releasing device 200 may not only be divided into two sections 210A and 210B, but also into two vertical layers. In particular, each of the two sections 210A and 210B may have a top layer 266 and a bottom layer 267 (FIG. 10). Providing a top layer 266 and a bottom layer 267 may increase the flow of the water vapor and moisture 99 out of the building while still providing for smaller openings for preventing insects from gaining access into the building. Further, the second unit moisture releasing device 200 may have a hard layer 275 (FIG. 9) located on the top of the top layer 266. Preferably, the hard layer 275 is made of a metal. In particular, the hard layer 275 is preferably made of a rust proof or resistant metal such as, for example, stainless steel or aluminum. The hard layer 275 may have a curved tip end 276 which is angled slightly downward from the top 201 of the second unit moisture releasing device 200. Preferably, the curved tip 276 is angled approximately thirty to sixty degrees downward with respect to the top. As illustrated in FIGS. 11-13, the curved tip 276 may run along the entire front 203 and the entire back 204 of the second unit moisture releasing device 200. The curved tip 276 may provide protection to the front 203 and to the back 204 of the second unit moisture releasing device 200 while still allowing water vapor and moisture 99 to flow through the passageways 208.

In an embodiment, a gap 285 may be located on the bottom 202 surface of the second unit moisture releasing device 200. The gap 285 may allow water vapor and moisture 99 to exit the walls of the building and enter the passageways 208 of the second unit moisture releasing device 200 wherein the water vapor and moisture 99 moves through the passageways 208 and out of the front 203 and the back 204 of the second unit moisture releasing device 200 at the vents 816. The gaps 285 therein allow the water vapor and moisture 99 to flow up through the wall into the device 1 at a location other than the empty space 815 of FIG. 9.

Figure 14:
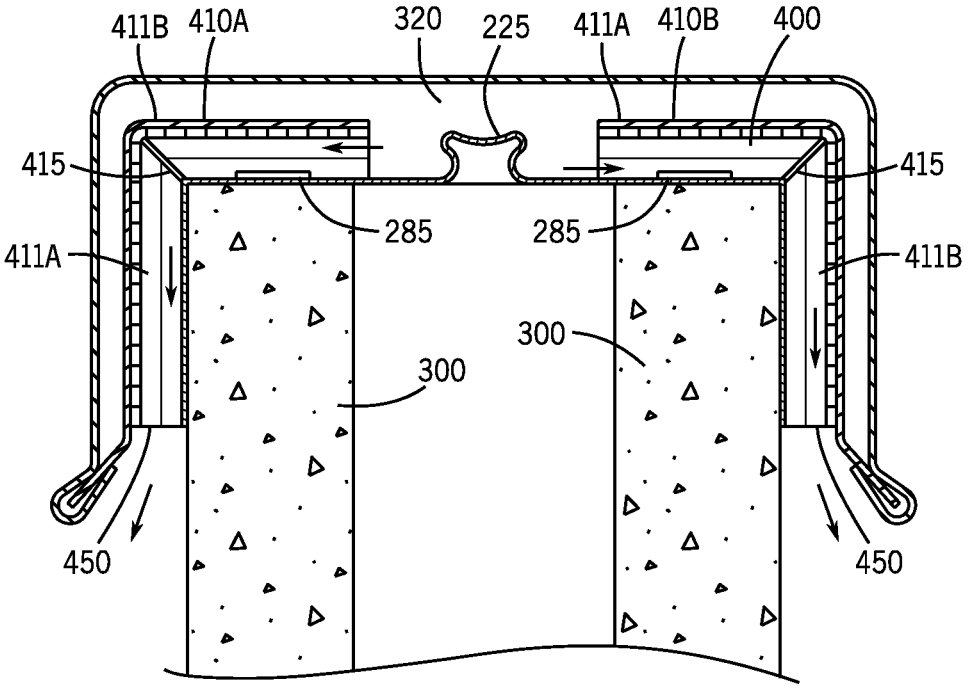
FIG. 14 illustrates a cross sectional view of an embodiment of a third unit moisture releasing device which is inserted under a metal coping on top of a parapet wall of a building.

Referring now to FIG. 14, in an embodiment, an alternative third unit moisture releasing device 400 may be provided. The third unit moisture releasing device 400 may be somewhat similar to the second unit moisture releasing device 200. However, the third unit moisture releasing device 400 embodiment may have two sections 410A and 410B wherein each of those sections is divided into two sections 411A and 411B. An interior edge 415 of the sections 411A and 411B may be tapered so as to allow the two sections 410A and 410B to be placed over a portion of the top and a portion of the side of the wall top. Preferably, the two sections 410A and 410B are mirror images of each other.

A gap 320 may further be located between the two sections 410A and 410B so as to allow the water vapor and moisture 99 to flow from the interior of the wall core empty space 815 out through openings 450 on the sides of the third unit moisture releasing device 400. Although not required, in an embodiment, the vapor permeable membrane 225 may connect the first section 410A to the second section 410B.

Figure 15:
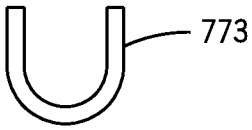
FIG. 15 illustrates a side view of a u-shaped protective barrier which is secured to the side of an embodiment of the first unit moisture releasing device wherein the u-shaped protective barrier is used to prevent water and/or insects from entering the first unit moisture releasing device.
Figure 16:
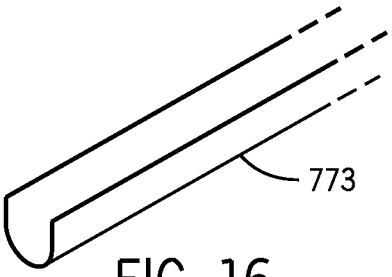
FIG. 16 illustrates a side perspective view of the device of FIG. 15.
Figure 17:
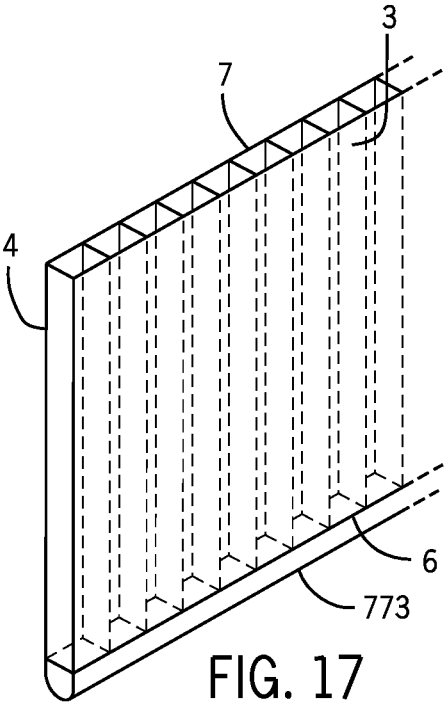
FIG. 17 illustrates a side perspective view of the u-shaped protective barrier secured to an embodiment of the first unit moisture releasing device.

Referring now to FIGS. 15-17 and as stated above, in an embodiment, the first unit moisture releasing device 1 may have a generally u-shaped protective barrier 773. The u-shaped protective barrier 773 may be located at, for example the first side 6 of the first unit 1C (or when used next to a joist). In particular, the u-shaped protective barrier 773 may be used in a foundation vapor release system (FIG. 1C) wherein the u-shaped protective barrier 773 is located at the very bottom of the system and prevents ground water and insects from entering the first unit 1.

Figure 18:
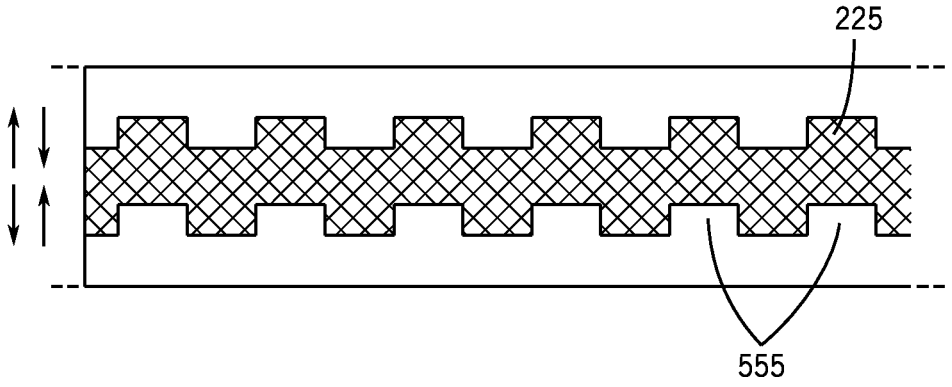
FIG. 18 illustrates an alternative embodiment to the top of the third unit moisture releasing device wherein the third unit moisture releasing device may be altered in size to fit under various sized capstones.

Referring now to FIG. 18, in an embodiment, the second unit 200 and/or third unit 400 may have teeth 555. More specifically, the teeth 555 may be staggered from the front 203 and the back 204 so that the front 203 may partially be moved past and partially lock with the back 204. In an embodiment, a vapor permeable membrane 225 may connect the front 203 and the back 204 so that the second unit 200 and/or third unit 400 each remain a single unit. Providing the second unit 200 and/or third unit 400 moisture releasing device with adjustable teeth 555 provides additional support to the device when the device is used on atypically wide walls. More specifically, the greater the thickness of the wall, the greater the space between the teeth 555 of the two sides of the device becomes. In an embodiment, the teeth 555 of the two units may lock together.

It should be noted that the second and third units of device may be designed to fit various sized parapet wall widths ranging from, for example, from 8" to 14.25". Allowing the device to be used with various parapet walls allows an installer to work with one package of materials regardless of the lack of continuity in dimensions of existing construction on any given project. In addition, waste may be eliminated by allowing the installer to purchase a single package that may be altered in various manners. Further, size adjustments may be made quickly and efficiently on site.

The various embodiments of the device (the first unit 1, second unit 200 and third unit 400) of the device 1 may be especially suitable for use in various construction environments. More specifically, although the device 1 may be used in numerous construction plans, the components of the device 1 are especially suitable for use: 1) inside metal coping; 2) under capstones; 3) vertically aligned with mortar joints against a wall or foundation and 4) on the inside of a parapet wall at the intersection of a wall and a roof system. Further, a single building may utilize the first unit 1, second unit 200 and/or third unit 400 to optimize the control and removal of water vapor and moisture 99.

Referring again to FIG. 1, in an embodiment, a hollow space 612 may be located in the interior of the building at the junction of the roof system, joists, truss systems and interior side of the exterior wall. The area between the bottom of the roof deck and the ceiling below, which houses the truss system, joists and insulation is called the roof cavity. The roof deck is typically sealed with a modified bitumen, TPO or other watertight roofing material. When the first unit 1A or first units 1A& B are used in conjunction, a 1" gap (612) between the entire perimeter of the exterior wall and the interior roof system is cut-away allowing for heat and moisture vapor (99) to rise from the roof cavity out to the exterior of the building via the first unit 1A through the hollow space 612 between the exterior wall, and the roof deck, the bottom of unit 1A through the plurality of generally elongated square passageways 10 of the first unit 1A moisture releasing device 1 and then out of the building through the vent 60. The 1" gap generally allows for the entire roof cavity to be ventilated, except where the joists of the building block this passage, typically at 16", 19⅜" or 24" on center.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

The invention claimed is:

1. A moisture releasing device for a building comprising:

a first and a second housing each having a top, a bottom, a front, a back, a first side, a second side and a generally hollow interior;

an opening on the first side of the first and second housing and an opening on the second side of the first and second housing wherein the opening on the first side of the first and second housing creates a generally hollow passageway which extends to the second side of the first and second housing and wherein water vapor or moisture passes through the generally hollow passageway from the first side to the second side of the first and second housing;

a gap in the bottom of the first and second housing wherein the gap creates an opening for the water vapor or moisture to enter into the generally hollow interior of the first and second housing at a location other than the first side or second side of the first and second housing;

wherein the bottom of the first and second housing is secured to a brick or concrete masonry unit of a building and wherein the generally hollow passageway of the first and second housing allows for the water vapor or moisture to be moved away from the brick or concrete masonry unit;

a vent attached to the building wherein the water vapor or moisture which moves through the generally hollow passageway of the interior of the first and second housing exits the building through the vent; and wherein the first and second housing are mirror images of each other and wherein a vapor permeable membrane connects the first and second housing.

2. The moisture releasing device for a building of claim 1 wherein the vapor permeable membrane is flexible and therein allows the distance from the first housing to the second housing to be adjusted.

3. The moisture releasing device for a building of claim 1 further comprising:

a first hard layer secured to the top of the first housing and a second hard layer secured to the top of the second housing and wherein the first and second hard layer do not cover the vapor permeable membrane located between the first housing and the second housing.

4. The moisture releasing device of claim 3 wherein the hard layer is a metal.

5. The moisture releasing device of claim 3 wherein the first hard layer secured to the first housing has an angled ledge which extends past the front of the first housing but not the back of the first housing and wherein the second hard layer has an angled ledge which extends past the front of the second housing but not past the back of the second housing and wherein the angled ledge of the first and second hard layer direct the flow of water vapor or moisture away from the building.

6. The moisture releasing device of claim 1 wherein the first housing and the second housing are located directly under a capstone of a building.

7. The moisture releasing device of claim 1 further comprising:

a plurality of teeth secured to the first housing and a plurality of teeth secured to the second housing wherein the plurality of teeth of the first housing and the plurality of teeth of the second housing are aligned to allow the first housing and the second housing to lock together or to be separated from each other while still allowing the passage of water vapor or moisture through the first and second housing.

* * * * *